US010820644B2

(12) United States Patent
Sarubbi

(10) Patent No.: US 10,820,644 B2
(45) **Date of Patent: *Nov. 3, 2020**

(54) SYSTEMS AND METHODS OF PERSONAL EFFECTS THAT PROMOTE HEALING

(71) Applicant: Kimberly Marie Sarubbi, Brentwood, TN (US)

(72) Inventor: Kimberly Marie Sarubbi, Brentwood, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/803,759

(22) Filed: Nov. 4, 2017

(65) Prior Publication Data

US 2019/0075866 A1 Mar. 14, 2019

Related U.S. Application Data

(62) Division of application No. 15/701,834, filed on Sep. 12, 2017.

(51) Int. Cl.

| | |
|---|---|
| ***A41D 27/20*** | (2006.01) |
| ***A41D 23/00*** | (2006.01) |
| *A61H 99/00* | (2006.01) |

(52) U.S. Cl.

CPC ..... *A41D 27/20* (2013.01); *A41D 23/00* (2013.01); *A61H 99/00* (2013.01); *A61H 2201/0157* (2013.01); *A61H 2201/10* (2013.01); *A61H 2201/165* (2013.01); *A61H 2201/1609* (2013.01)

(58) Field of Classification Search

CPC .. A41D 27/20; A41D 23/00; A61H 2201/165; A61H 99/00; A61H 2201/0157; A61H 2201/1609; A61H 2201/10

See application file for complete search history.

(56) References Cited

U.S. PATENT DOCUMENTS

| | | | | |
|---|---|---|---|---|
| 6,014,973 | A * | 1/2000 | Kaufman | A61K 35/32 128/897 |
| 6,378,138 | B1 | 4/2002 | Ridgley | |
| 2003/0164626 | A1 | 9/2003 | Lardieri | |
| 2004/0030270 | A1 | 2/2004 | Johnson | |
| 2006/0218692 | A1* | 10/2006 | Lamarque | A41D 13/1245 2/114 |
| 2007/0239212 | A1* | 10/2007 | Schneider | A43B 1/0045 607/2 |
| 2012/0226095 | A1* | 9/2012 | Young | A61M 21/00 600/15 |
| 2014/0298560 | A1* | 10/2014 | Bailey, II | A41D 13/0015 2/69 |
| 2015/0224011 | A1 | 8/2015 | Scott | |
| 2016/0287928 | A1* | 10/2016 | Darnell | A63B 21/4037 |

FOREIGN PATENT DOCUMENTS

| | | | |
|---|---|---|---|
| CA | 2778854 | A1 | 12/2013 |
| GB | 2461947 | A | 1/2010 |
| GB | 2468175 | A | 9/2010 |
| GB | 2473487 | A | 3/2011 |

* cited by examiner

*Primary Examiner* — Quang D Thanh
(74) *Attorney, Agent, or Firm* — Lynch LLP; Sean Lynch

(57) ABSTRACT

Systems and methods of improving new age healing techniques. Personal effects including solids understood by practitioners of new age healing techniques to have vibrational qualities that are thought to improve health of body and mind. Personal effects including conductive elements coupling one or more solids to each other and to the user/wearer of the personal effect to improve the benefits to that user/wearer. Methods of improving health involving personal effects of the inventive subject matter.

6 Claims, 3 Drawing Sheets

SYSTEMS AND METHODS OF PERSONAL EFFECTS THAT PROMOTE HEALING

This application is a divisional of U.S. patent application Ser. No. 15/701,834, filed Sep. 12, 2017.

FIELD OF THE INVENTION

The field of the invention is personal effects and garments that promote healing and good health.

BACKGROUND

The background description includes information that may be useful in understanding the present invention. It is not an admission that any of the information provided in this application is prior art or relevant to the presently claimed invention, or that any publication specifically or implicitly referenced is prior art.

In the context of the inventive subject matter, several factors are well understood. Most importantly, the placebo effect and the tenets of new age healing. For example, it is well-established that the placebo effect impacts personal health and well-being—even in instances where the recipient of the placebo is aware of that fact. Research on the placebo effect has focused on the relationship of mind and body. One of the most common theories is that the placebo effect is due to a person's expectations. If a person expects a pill to do something, then it's possible that the body's own chemistry can cause effects similar to what a medication might have caused.

Experts also say that there is a relationship between how strongly a person expects to have results and whether or not results occur. The stronger the feeling, the more likely it is that a person will experience positive effects.

Proponents of new age healing techniques maintain that crystals can alleviate stress, boost creativity, cure disease, raise levels of consciousness and enhance psychic powers in areas such as divination and dowsing. The belief that quartz and semi-precious stones contain a subtle power unknown to science is a key part of the New Age industry, which is widely accepted among certain groups. Proponents also maintain that these effects are currently outside the testable boundaries of science, and stem from auras, vibrations, and frequencies related to different materials and entities. Different crystals (and other solids such as fossils, orgonite, and so on) are also thought to possess different levels of energy and produce different effects.

And so, even if it assumed that new age healing techniques are medically ineffective, if a person implements or tries a new age healing technique, the placebo effect is nevertheless established as being effective in bringing about the desired effect in that person. If the person trying the new age healing technique harbors a strong belief in that technique, that person is statistically more likely to experience even more positive results.

Thus, given that large groups of individuals believe in the positive benefits of new age healing techniques, those groups of people stand to benefit greatly from devices and methods that are designed to improve their experience of the placebo effect.

Efforts to develop new age healing-related techniques and devices have been made in the past. GB2473487A teaches garments that incorporate crystals that are "positioned on to an appropriate part of the body." But the '487 application fails to consider many different features that can improve a user's experience. It is well-established that a solid (e.g., crystals) can be placed in clothing, but far more improvements can still be made that take into consideration more modern scientific understandings of certain materials.

Moreover, U.S. Pat. No. 6,378,138 includes several teachings related to how various solids (e.g., crystals) can be incorporated into clothing. But just like the '487 application, the '138 patent fails to appreciate how these very rudimentary implementations can be improved upon to more effectively bring about a desired improvement in a person's health or well-being.

These and all other extrinsic materials discussed in this application are incorporated by reference in their entirety. Where a definition or use of a term in an incorporated reference is inconsistent or contrary to the definition of that term provided in this application, the definition of that term provided in this application applies and the definition of that term in the reference does not apply.

Thus, there is still a need in the art for improved new age healing devices, systems, and methods.

SUMMARY OF THE INVENTION

The present invention provides apparatuses, systems, and methods in which new age healing techniques are leveraged to bring about a desired effect on a person's health and/or well-being.

In one aspect of the inventive subject matter, a personal effect is contemplated. The personal effect includes at least two solids that are each associated with a vibrational rate (e.g., the same or different vibrational rates), and which are both coupled with the personal effect. The personal effect also includes a conductive element (e.g., a thread or fabric) that couples the first solid to the second solid. It is contemplated that the conductive element, in some embodiments, has electromagnetic field shielding properties.

Solids coupled with the personal effect can include any combination of a crystal, a mineral, an orgonite, a stone, a gemstone, a rock, a crystal cluster, a mineral, a fossil, and a rune stone. In some embodiments, solids can be directly incorporated into the personal effect by, for example, sewing or stitching the solids into the fabric (or other suitable material) of the personal effect. In some embodiments, the solids are coupled with the personal effect by placement in pockets that are affixed to the personal effect (e.g., by stitching or sewing). The pockets can be made from, in part or in whole, electromagnetic field shielding fabric.

In some embodiments, the personal effect includes at least one conductive material that is coupled with the personal effect such that it is accessible on one or both sides of the personal effect.

In another aspect of the inventive subject matter, a method of improving personal health is contemplated. In one embodiment, the method includes the steps of: (1) selecting a solid, where the solid is associated with a vibrational rate and the vibrational rate is associated with bringing about a desired effect on a human body; (2) incorporating the solid into a personal effect, where the personal effect is sized and dimensioned to be worn such that the solid is positioned in a location associated with bringing about the desire effect; and (3) incorporating a conductive material (e.g., a conductive thread or fabric) into the personal effect such that an interaction between the conductive element and the solid are associated with bringing about the desired effect.

In some embodiments, the solid can be, for example, one or more or any combination of one or more of, a crystal, a mineral, an orgonite, a stone, a gemstone, a rock, a crystal cluster, a mineral, a fossil, and a rune stone.

Some embodiments of the method include the additional step of incorporating, into the personal effect, a fabric having electromagnetic field shielding properties. It is also contemplated that, in embodiments of the method, the solid can be coupled with the personal effect by placement in a pocket that is coupled with the personal effect. The pocket can additionally be made in whole or in part by materials having electromagnetic field shielding properties.

One should appreciate that the disclosed subject matter provides many advantageous technical effects including improvement of mood and health as a result of real or perceived efficacy of systems or methods of the inventive subject matter.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
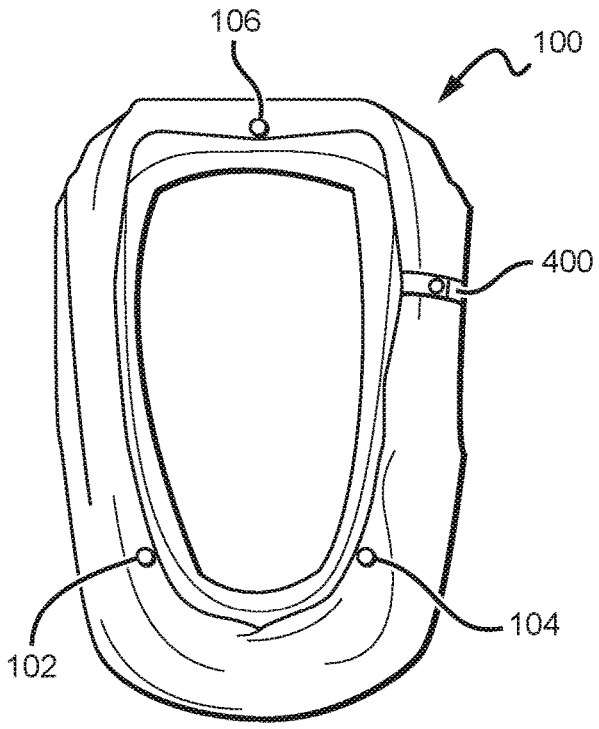
FIG. 1 is a front view of a scarf embodiment of the inventive subject matter.

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

Also, as used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

Crystal healing proponents believe that crystals and gemstones have properties that facilitate healing. Many websites promoting crystal healing allege that the history of this practice is ancient, dating back at least 6,000 years to the time of the ancient Sumerians of Mesopotamia. Ancient Egyptians are also referenced on such websites as being among the first people to have adorned themselves with crystals—including lapis lazuli, carnelian and turquoise—to ward off illness and negative energy.

But the philosophy of modern crystal healing (or, more generally, "new age healing") is based on traditional concepts borrowed from Asian cultures, most notably the Chinese concept of life-energy (ch'i or qi) and the Hindu or Buddhist concept of chakras, which are vortices of this life-energy, said to connect the physical and supernatural elements of the body.

In crystal healing, stones are assigned various properties, though healers have different ideas about which stones possess which properties. Amethyst, for example, is believed by some to be beneficial for the intestines; green aventurine helps the heart; yellow topaz provides mental clarity. Colors red through violet are associated with seven chakra points on the body.

During a treatment session, a new age healer may place various stones, solids, or crystals on your body aligned with these chakra points, roughly in the regions above the head, on the forehead, on the throat, on the chest, on the stomach, on the gut, and on the genital area. The stones used and their positioning may be chosen for the symptoms reported by the patient. This is all influenced by the healer's knowledge of, and belief in, the chakra philosophy of disease and energy imbalances—a philosophy that is largely dismissed by practitioners of medicine.

New age healing also often involves the use of crystals and stones worn on the body or placed under pillows to ward off sickness, shed negative energy or absorb positive energy. Although these new age healing techniques are understood by its practitioners to be effective in their own right, it is contemplated that various devices and methods can be implemented to improve the efficacy of the techniques. Specifically, personal effects can incorporate new age healing techniques in new ways that bring about improved health and well-being in the people that wear or use those effects, at least by virtue of the placebo effect if not also the efficacy of those techniques on their own.

In this application, a "solid" is a material that new age healing techniques regard as having characteristics that are useful in promoting healing, well-being, or other desirable qualities. A solid can be, for example, a crystal, a mineral, an orgonite, a stone, a gemstone, a rock, a crystal cluster, a mineral, a fossil, and a rune stone. All of these solids share some common characteristics, including that they are all understood by new age healing communities and practitioners to have energy properties that benefit the human body. They are all believed to have naturally occurring features (e.g., elements, characteristics, vibrations, auras, etc.) that heal and help aid energy flow in the human body. Depending on the placement (on the person) and the understood vibration level of that naturally occurring element, the effect can be more or less effective.

More examples of solids associated with new age healing techniques include: alexandrite, amazonite, amber, amethyst, aquamarine, aventurine, azurite, bloodstone, calcite, carelian, celestite, chrysoprase, citrine, diamond, dioptase, emerald, fluorite, garnet, gold, hematite, herkimer diamond, jade, jasper, kunzite pink, lapis lazuli, lepidolite, malchite, moonstone, obsidian, onyx, opal, peridot, pyrite, quartz crystal, rhodochrosite, rhodonite, rose quartz, ruby, rutilated quartz, smoky quartz, sugilite, sodalite, sapphire, silver, tiger eye, topaz, tourmaline, turquoise, zircon.

Each of the above-mentioned solids has an associated desirable effect. The following list includes descriptions of the benefits and effects of the various solids as understood by the new age healing community:

Alexandrite—Has positive influence on nervous system.

Amazonite—Strengthens heart and physical body. Facilitates clearer vision of one's own harmful tendencies.

Amber—Exerts positive influence on endocrine system. Electrically alive. Harmonizing.

Amethyst—Strengthens endocrine and immune systems. Enhances right brain activity. Cuts through illusion. Excellent for meditation.

Aquamarine—Calms nerves, reduces fluid retention, helps banish fears and phobias. Peace.

Aventurine—Stimulates muscle tissue. Emotional tranquility. Independence.

Azurite—Enhances flow of energy through nervous system. Strengthens blood. Creativity.

Bloodstone—Strengthens and oxygenates bloodstreams. Aids in balancing iron deficiencies. Idealism.

Calcite—Balances male/female polarities. Emotionally balancing. Ground excess energy. Joy.

Carelian—Very highly evolved mineral healer. Aids tissue regeneration. Enhances attunement with inner self Celestite—Enhances thyroid functions. Reduces stress. Aids personal creative expression. Truth.

Chrysoprase—Balances neurotic patterns. Eases depression. Brings out inner talents.

Citrine—Good for kidneys. Raises self-esteem. Abundance.

Diamond—Aids alignment of cranial bones. Master healer. Purity.

Dioptase—Strengthens cardiovascular and central nervous system. Excellent aid for blood pressure. Well-being.

Emerald—Strengthens heart and liver. Aids alignment of subtle bodies. Prosperity.

Fluorite—Improves absorption of vital nutrients. Beneficial for blood vessels. Powerful healer.

Garnet—Strengthens, purifies. Helping to harmonize the potent forces. Stimulates pituitary gland. Love.

Gold—Purifies and energizes physical body. Improves circulation. Aids tissue regeneration. Amplifies thought.

Hematite—Has positive affect upon bloodstream. Increases resistance to stress. Optimism.

Herkimer Diamond—Cleanses subtle bodies. Reduces stress. Powerful amplifier. Awareness.

Jade—Strengthens heart and immune system. Aids eye disorders and female problems. Wisdom.

Jasper—Strengthens gallbladder. Impact on physical body. Powerful healer.

Kunzite Pink—Strengthens cardiovascular system. Tolerance, acceptance, calming.

Lapis Lazuli—Strengthens skeletal system. Releases tension. Augments strength. Clarity Lepidolite—Aids muscles, strengthens heart. Aids sleep. Joy.

Malchite—Aids functions of pancreas and spleen. Vitalizing for body and mind. Reveals subconscious blocks.

Moonstone—Has healing affinity with stomach. Relieves anxiety and stress. Aids birthing process. Flexibility in attitudes.

Obsidian—Beneficially influences stomach and intestines. Grounds spiritual energy into physical plane. Helps clear subconscious blocks.

Onyx—Balances male/female polarities. Strengthens bone marrow. Self-control.

Opal—Stimulates pineal and pituitary glands. Emotional balancer. Enhances intuition.

Peridot—Balances glandular system. Purifies body, enhances bloodstream, reduces stress. Personal growth Pyrite—Strengthens and oxygenates blood. Enhances brain functions. Enhances emotional body Harmony Quartz Crystal—Enhances the crystalline properties of blood. Activates and enhances pineal and pituitary gland. Excellent for meditation.

Rhodochrosite—Aids spleen, kidneys, and heart. Enhances memory. Acceptance of self and life Rhodonite—Aids central nervous system. Body reflexes. Reduces stress, calms mind. Strength.

Rose Quartz—Aids circulatory system. Reduces stress and tension. Love stone.

Ruby—Aids in regeneration of heart. Activates sluggish or dormant conditions.

Rutilated Quartz—Regeneration of tissue throughout body. Stimulates brain functions. Communication Smoky Quartz—Strengthens adrenals. Mildly sedative and relaxing. Excellent for meditation.

Sugilite—Enhances functions of pineal, pituitary, and adrenal glands. Activates and balances brain hemispheres. Sensitivity.

Sodalite—Strengthens metabolism and lymphatic system. Alleviates fear. Truth.

Sapphire—Strengthens heart and kidneys. Aids glandular system. Strengthens will.

Selenite—Strengthens bones and teeth. Has positive effect on brain. Clarity.

Silver—Enhances mental functions. Excellent energy conductor. Speech.

Tiger Eye—Beneficial for spleen, pancreas, digestive organs, and colon. Emotional balances Helps soften stubbornness. Insight.

Topaz—Gold—Detoxifies body. Abundance.

Blue—Tissue regeneration. Strengthens thyroid. Tranquility.

Tourmaline—Aids sleep. Aligns subtle bodies. Inspiration.

Turquoise—Tones, strengthens entire body. Creative expression. Friendship and loyalty.

Zircon—Aids bowel problems and emotional balance. Self-esteem. All around healer.

This is not intended to be an exhaustive list.

FIG. 1 shows an embodiment of such a personal effect. The embodiment in FIG. 1 takes the form of a scarf 100. The scarf 100, though pictured as an infinity scarf, can take the form of a traditional scarf in other embodiments. Shown on the scarf 100 are two mudra points 102 & 104 and one qi tag 106. It is contemplated that mudra points and qi tags can be incorporated into personal effects of the inventive subject matter in any quantity (e.g., preferably 1-10, but also 10-15 and 15-25).

Figure 2:
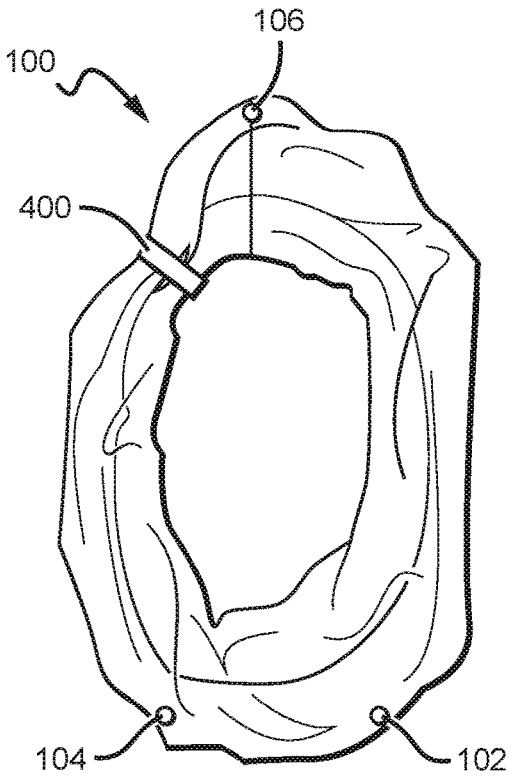
FIG. 2 is a rear view of a scarf embodiment of the inventive subject matter.
Figure 3:
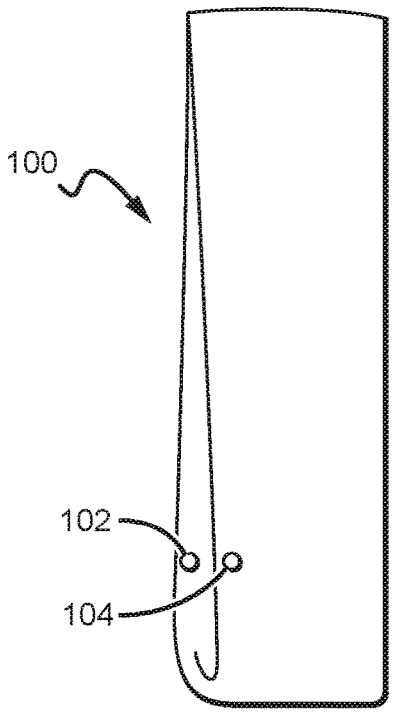
FIG. 3 is a side view of a scarf embodiment of the inventive subject matter.

A "mudra point" as used in this application is a connective point on the personal effect that is optionally conductive. It can be grasped by a person using or wearing the effect, or it can be positioned so that it comes into contact with the user or wearer's skin (e.g., preferably directly, but also indirectly). The mudra points 102 & 104, and the qi tag 106, shown in FIG. 1 can also be seen in FIG. 2, which shows a rear view of the scarf 100. In embodiments where the mudra points run through the personal effect (e.g., as shown in FIGS. 1-3 where the mudra points are accessible on two sides because they pass through the fabric or material of the personal effect), it is possible for a wearer or user to grasp the mudra points from both sides with their thumbs and any of their other fingers.

A "mudra" is a body position that is associated with influence on the energies of the body or mood. Generally, only the hands and fingers are held in a position, but the whole body may be part of the mudra as well. Many mudras involve connecting a thumb and finger together to make a circle between the two digits. Thus, in the embodiment shown in FIGS. 1-3, the mudra points 102 & 104 are designed and positioned such that a wearer could use mudra points 102 & 104 as a point of contact for both the wearer's thumb and one of their fingers to create a circle (e.g., pinching). FIG. 3 is a side view of the scarf 100 showing mudra points 102 & 104.

The qi tag 106, which is functionally similar to a mudra point (e.g., it can be identical to the mudra points in construction and materials), on the other hand, is positioned so that it makes contact with the skin of the back of the wearer's neck to improve the wearers connectivity to the scarf 100.

It is additionally contemplated that mudra points can be coupled with one another within the personal effect via one or more conductive materials. In some embodiments, a conductive thread is implemented into the personal effect (e.g., a thread that is made from, or includes, a conductive material such as silver, copper, or any other conductive metal or alloy). Linking mudra points in this way improves the wearers perceived connectivity to the positive benefits of the personal effect and the solids incorporated therein. Improving connectivity between mudra points can improve the beneficial effects to the wearer or user of the personal effect by virtue of both real and perceived (e.g., placebo) benefits.

In embodiments of the inventive subject matter that are not scarves (e.g., other items of clothing or accessories like purses and handbags), the mudra points and the qi tag can be located in different positions on the personal effect to bring about the desired result.

Figure 4:
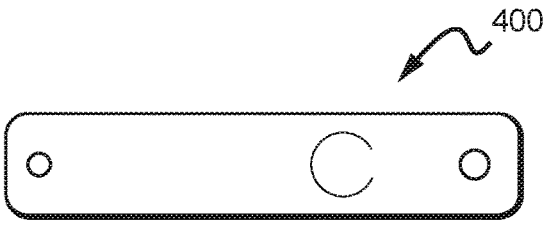
FIG. 4 shows a strap that can be used with embodiments of the inventive subject matter.

FIG. 4 shows strap 400 that can be used with embodiments of the inventive subject matter. It is also visible in FIGS. 1 & 2. The strap 400 is an optional component, and when implemented it can be used to conceal additional solids.

Figure 5:
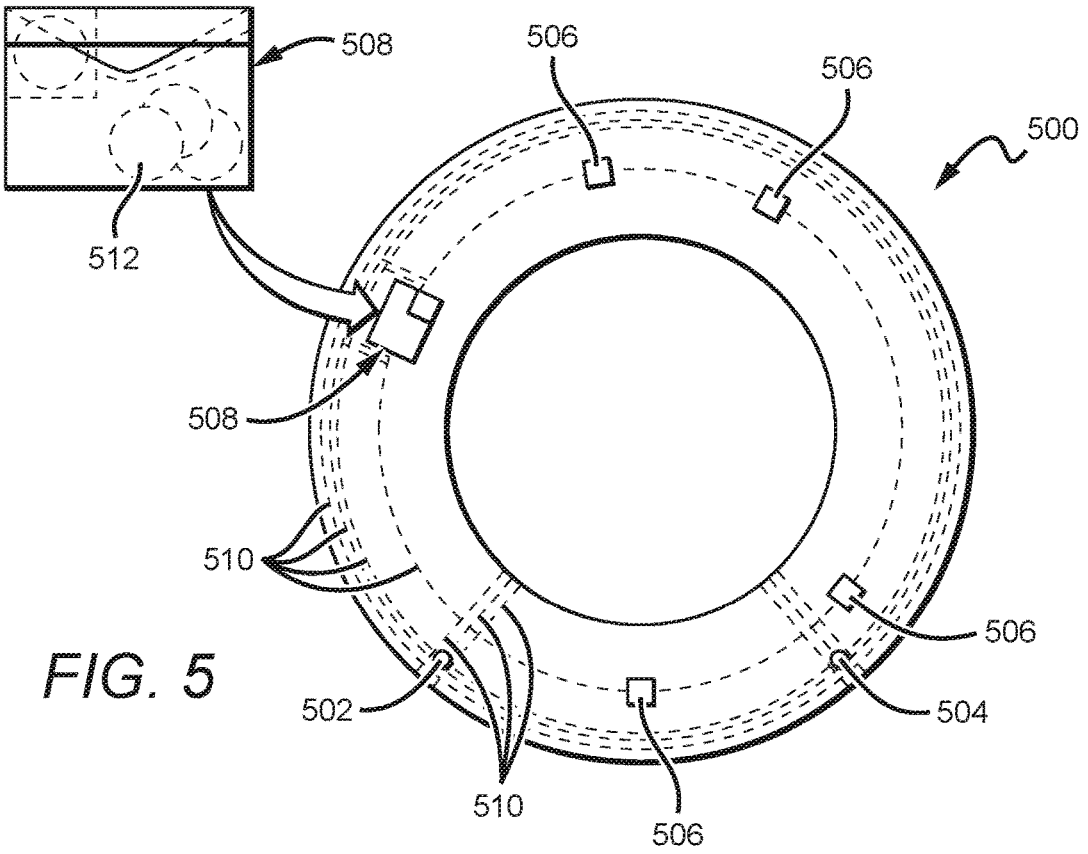
FIG. 5 shows mudra points, as well as a pocket to hold solids, on an embodiment of the inventive subject matter.
Figure 6:
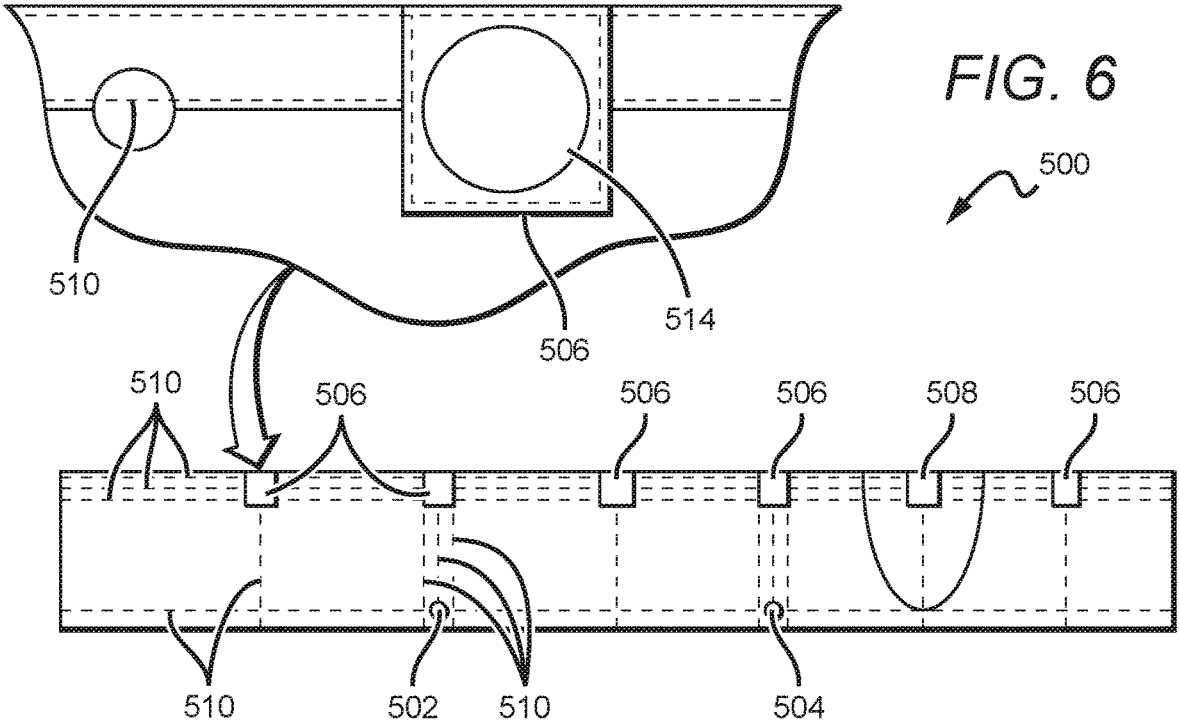
FIG. 6 shows an alternative view of the scarf in FIG. 5.

FIGS. 5 & 6 show a scarf embodiment 500 having two mudra points 502 & 504 and as well as several pockets 506, along with a swapping pocket 508, to hold solids 512 & 514. In pockets 506, solids 514 can also be sewn into a cavity in the personal effect, as shown in FIG. 6. A swapping pocket 508 is functionally similar, except that the solid 512 in the swapping pocket 508, as shown in FIG. 5, can be replaced. It is contemplated that any combination, alone or in combination, of swapping pocket(s) and regular pockets (e.g., pockets 506) can be incorporated into embodiments of the inventive subject matter.

Pockets of the inventive subject matter can be made in several ways. In some embodiments, the entire pocket is made from an electromagnetic shielding fabric. This is understood to amplify the effects of the solids contained in the pocket. In other embodiments, the pocket is made from an ordinary fabric. Regardless, it is contemplated that the solids contained in the pockets can be coupled to other pockets, the mudra points, and qi tags by a conductive material, as described above.

The scarf 500 is depicted in a circular configuration to make it easier to visualize its features. For example, FIGS. 5 & 6 shows conductive materials (e.g., threads) 510 that links the mudra points 502 & 504 to each other, the pockets 506 & 508 to each other, and the mudra points 502 & 504 to the pockets 506 & 508. It is contemplated that conductive materials 510 can be implemented to couple any combination of pockets 506 & 508, mudra points 502 & 504, and qi tags (shown in FIGS. 1-3 and also contemplated with respect to the embodiment in FIGS. 5 & 6) to one another.

It is contemplated that a conductive material 510, as used in embodiments of the inventive subject matter, is preferably made from silver or a silver alloy, but all conductive materials are nevertheless contemplated. Conductive material 510 can be configured to couple with both sides of each pocket 506 & 508 containing a solid (or mudra point 502 & 504 or qi tag), and the conductive material 510 can then run through the entirety of scarf 500 to form a complete loop, passing through—or coupling with—each of the pockets 506 & 508 to hold solids 512 & 514. It is also contemplated that the conductive material 510 can be a fabric (e.g., the some or all of the personal effect can be made from a conductive fabric).

Figure 7:
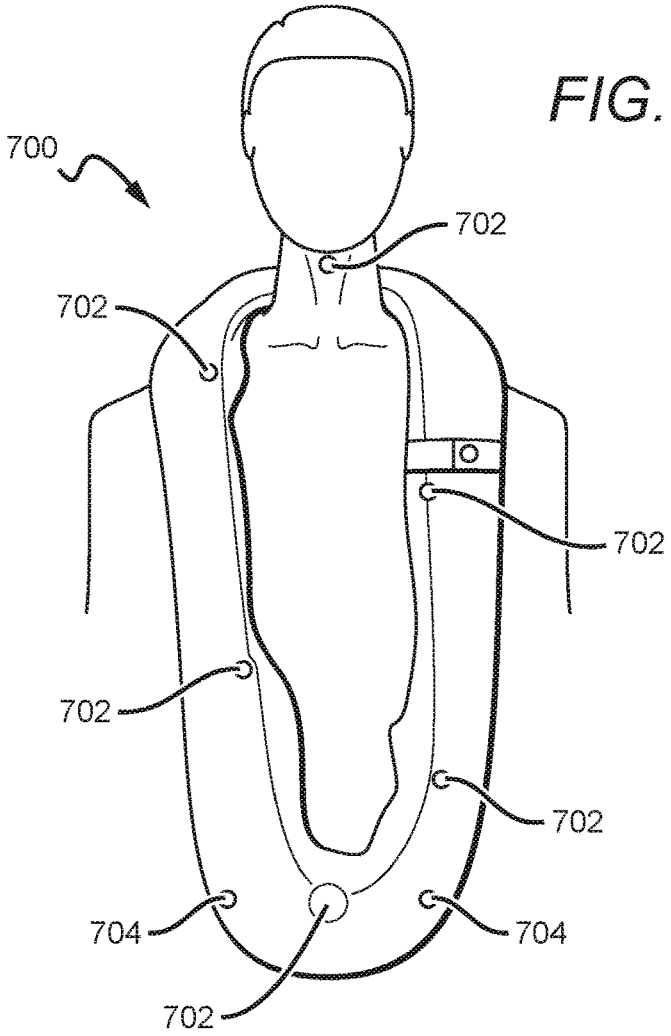
FIG. 7 shows a scarf embodiment of the inventive subject matter as worn by a person, indicating locations of mudra points relative to the body of the wearer.

As shown in FIG. 7, solids can be incorporated into personal effects of the inventive subject matter at regular (or irregular) intervals at locations that correspond to chakra points 702. The locations of the pockets 506 & 508 in FIG. 6 correspond roughly to chakra points 702 as seen in FIG. 7, though it is contemplated that it is not strictly necessary for solids residing in pockets to align with charka points.

FIG. 7 shows a scarf 700 of the inventive subject matter as worn by a person, indicating locations of chakra points 702 relative to the body of the wearer, and also indicating mudra points 704 on the person. When the scarf 700 is worn, the mudra points 704 are accessible to the person wearing the scarf 700 so that they can pinch the mudra points 704, thereby improving that person's perceived connection to the solids incorporated into the scarf 700 (not visible in FIG. 7, but shown in FIGS. 5 & 6) that are contained in the scarf 700.

By wearing the scarf 700, those who ascribe to new age healing techniques experience amplified benefits of the solid(s) that are incorporated into the scarf 700 (e.g., by stitching or by pocket, as described above). The scarf 700 is sized and dimensioned to run along the chakra points 702 indicated in FIG. 7, and the construction of the scarf 700 (e.g., conductive threads and/or fabrics connecting the solid to the mudra points and the rest of the scarf) ensures that the positive effects of the solid(s) incorporated into the scarf 700 across a greater portion of the wearer's body.

Figure 8:
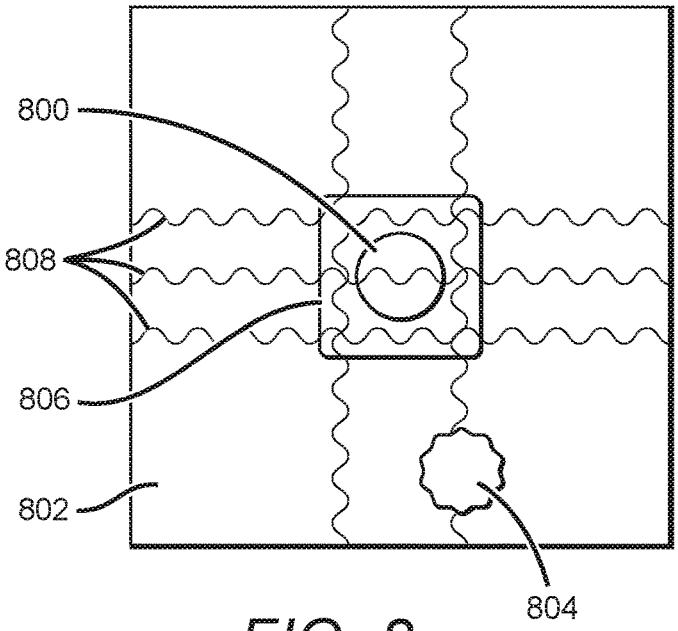
FIG. 8 shows a schematic of how a solid that is incorporated into an embodiment of the inventive subject matter can be coupled with other portions of the embodiment by conductive components.

FIG. 8 shows a schematic of how a solid 800 that is incorporated into a personal effect 802 of the inventive subject matter can be connected to a mudra point 804 that is coupled to that personal effect 802. It is contemplated that a solid 800 can be placed in the center of a "sacred square" 806, which is preferably made from a conductive material. The sacred square 806 can be incorporated into, or coupled with, any type of pocket as discussed above. Conductive threads 808 and the sacred square 810 (e.g., when made from a conductive fabric) can then couple with the sacred square 806 (and, by association, with the solid 800), to improve or amplify the desired effects of the solid 800 on the individual wearing or using the personal effect 802. Although a mudra point 804 is shown, it is contemplated that the schematic shown in FIG. 8 also applies to qi tags.

Thus, specific devices and methods related to new age healing have been disclosed. It should be apparent, however, to those skilled in the art that many more modifications besides those already described are possible without departing from the inventive concepts in this application. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A method of improving personal health with a garment, the method comprising the steps of:

incorporating a first mudra point into the garment in a first location, wherein the first mudra point is associated with influence on energies of a user's body or mood;

wherein, upon incorporating a first solid into the garment, a front portion of the first mudra point is on a front side of the garment and a back portion of the first mudra point is on a back side of the garment and wherein the front portion is positioned at the same first location on the front side of the garment and the back portion is positioned at the same first location on the back side of the garment;

incorporating a conductive material into the garment such that the conductive material couples with the first mudra point between the front portion and the back portion; and positioning the garment on the user's body such that the user graps the first mudra point from both the front and back sides of the garment.

2. The method of claim 1, wherein the conductive material comprises at least one of a thread and a fabric.

3. The method of claim 1, further comprising the step of incorporating, into the garment, a fabric having electromagnetic field shielding properties.

4. The method of claim 1, further comprising the step of incorporating a pocket into the garment to accommodate a solid.

5. The method of claim 4, further comprising the step of incorporating the conductive material into the garment such that the first solid is coupled with the pocket by the conductive material.

6. The method of claim 1, wherein the garment is an infinity scarf, and wherein the conductive material is incorporated into the infinity scarf as a loop.

* * * * *